US006747602B2

(12) United States Patent
Matsuoka et al.

(10) Patent No.: US 6,747,602 B2
(45) Date of Patent: Jun. 8, 2004

(54) GLASS ANTENNA FOR AN AUTOMOBILE

(75) Inventors: Akiko Matsuoka, Kanagawa (JP); Hijiri Ichihara, Kanagawa (JP)

(73) Assignee: Asahi Glass Company, Limited, Tokyo (JP)

( * ) Notice: Subject to any disclaimer, the term of this patent is extended or adjusted under 35 U.S.C. 154(b) by 54 days.

(21) Appl. No.: 10/128,283

(22) Filed: Apr. 24, 2002

(65) Prior Publication Data

US 2002/0180652 A1 Dec. 5, 2002

(30) Foreign Application Priority Data

Apr. 25, 2001 (JP) ..... 2001-127979

(51) Int. Cl.[7] ..... H01Q 1/32
(52) U.S. Cl. ..... 343/713; 343/711
(58) Field of Search ..... 343/713, 711, 343/712, 873

(56) References Cited

U.S. PATENT DOCUMENTS 3,810,180 A * 5/1974 Kunert et al. ..... 343/713
4,668,925 A * 5/1987 Towatari et al. ..... 333/219

FOREIGN PATENT DOCUMENTS

| | | |
|---|---|---|
| JP | 54-85954 | 11/1977 |
| JP | 11-243311 | 9/1999 |

* cited by examiner

*Primary Examiner*—James Clinger
(74) *Attorney, Agent, or Firm*—Oblon, Spivak, McClelland, Maier & Neustadt, P.C.

(57) ABSTRACT

A glass antenna for an automobile, comprising an antenna strip obtained by forming a linear silver paste on an automobile window glass sheet and firing the silver paste layer, wherein the electric resistance per unit length of the antenna strip is 0.2 Ω/cm or less, and in the coordinate plane defined by an ordinate which indicates a thickness t(μm) of antenna strip and an abscissa which indicates a width w(mm) of antenna strip, w and t exist in the region surrounded by the following curved line A1, straight line B1, straight line C1 and straight line C4:

t=2.5/w . . . curved line A1, t=100 . . . straight line B1, w=0.05 . . . straight line C1 and w=0.41 . . . straight line C4

12 Claims, 2 Drawing Sheets

GLASS ANTENNA FOR AN AUTOMOBILE

BACKGROUND OF THE INVENTION

1. Field of the Invention

The present invention relates to a glass antenna for an automobile, suitable for receiving broadcast signals of radio or television.

2. Discussion of Background

There has been known a glass antenna for an automobile in which an antenna strip having a width of 0.4 mm or less is provided on a rear window glass sheet of automobile in order to assure an excellent viewing field (JP-A-11-243311).

In such conventional antenna strip, however, there is no description about the thickness of the conductor as the antenna strip, and the relation between the thickness of the conductor and the telecommunication characteristics such as sensitivity and so on of the antenna strip, and the relation between the width of the antenna strip and the thickness of the conductor of the antenna strip were unclear. Further, the electrical characteristics of the material used for the antenna strip were also unclear.

Further, in a commercially available automobile, the width of the antenna strip was 0.7 mm or more and the thickness of the antenna strip was about 5 $\mu$m. If the thickness of the antenna strip having a width of 0.41 mm or less was determined to be about 5 $\mu$m, there might cause deterioration in the telecommunication characteristics. If the thickness was excessively large, it would be difficult to obtain a good sintered product whereby there was a problem of poor productivity.

It is an object of the present invention to provide a glass antenna for an automobile, which can assure an excellent viewing field and which provides good telecommunication characteristics and productivity.

SUMMARY OF THE INVENTION

In accordance with the present invention, there is provided a glass antenna for an automobile, comprising an antenna strip obtained by forming a linear silver paste layer on an automobile window glass sheet and firing the silver paste layer, the glass antenna for an automobile being characterized in that:

the electric resistance per unit length of the antenna strip is 0.2 Ω/cm or less, and in the coordinate plane defined by an ordinate which indicates a thickness t($\mu$m) of antenna strip and an abscissa which indicates a width w(mm) of antenna strip, w and t exist in the region surrounded by the following curved line A1, straight line B1, straight line C1 and straight line C4:

t=2.5/w . . . curved line A1,
t=100 . . . straight line B1,
w=0.05 . . . straight line C1 and
w=0.41 . . . straight line C4.

Further, according to the present invention, there is provided a glass antenna for an automobile, comprising an antenna strip obtained by forming a linear silver paste layer on an automobile window glass sheet and firing the silver paste layer, the glass antenna for an automobile being characterized in that:

the electric resistance per unit length of the antenna strip is 0.1 Ω/cm or less, and in the coordinate plane defined by an ordinate which indicates a thickness t($\mu$m) of antenna strip and an abscissa which indicates a width w(mm) of antenna strip, w and t exist in the region surrounded by the following curved line D1, straight line B1, and straight line C4:

t=5.0/w . . . curved line D1,
t=100 . . . straight line B1 and
w=0.41 . . . straight line C4.

Further, according to the present invention, there is provided a glass antenna for an automobile, comprising an antenna strip obtained by forming a linear silver paste layer on an automobile window glass sheet and firing the silver paste layer, the glass antenna for an automobile being characterized in that:

the electric resistance per unit length of the antenna strip is 0.2 Ω/cm or less, and in the coordinate plane defined by an ordinate which indicates a thickness t($\mu$m) of antenna strip and an abscissa which indicates a width w(mm) of antenna strip, w and t exist in the region surrounded by the following curved line A1, straight line E and straight line C4:

t=2.5/w . . . curved line A1,
t=(40/0.3)w+30 . . . straight line E and
w=0.41 . . . straight line C4.

Further, according to the present invention, there is provided a glass antenna for an automobile, comprising an antenna strip obtained by forming a linear silver paste layer on an automobile window glass sheet and firing the silver paste layer, the glass antenna for an automobile being characterized in that:

the electric resistance per unit length of the antenna strip is 0.1 Ω/cm or less, and in the coordinate plane defined by an ordinate which indicates a thickness t($\mu$m) of antenna strip and an abscissa which indicates a width w(mm) of antenna strip, w and t exist in the region surrounded by the following curved line D1, straight line E, and straight line C4:

t=5.0/w . . . curved line D1,
t=(40/0.3)w+30 . . . straight line E and
w=0.41 . . . straight line C4.

BRIEF DESCRIPTION OF DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

Figure 1:
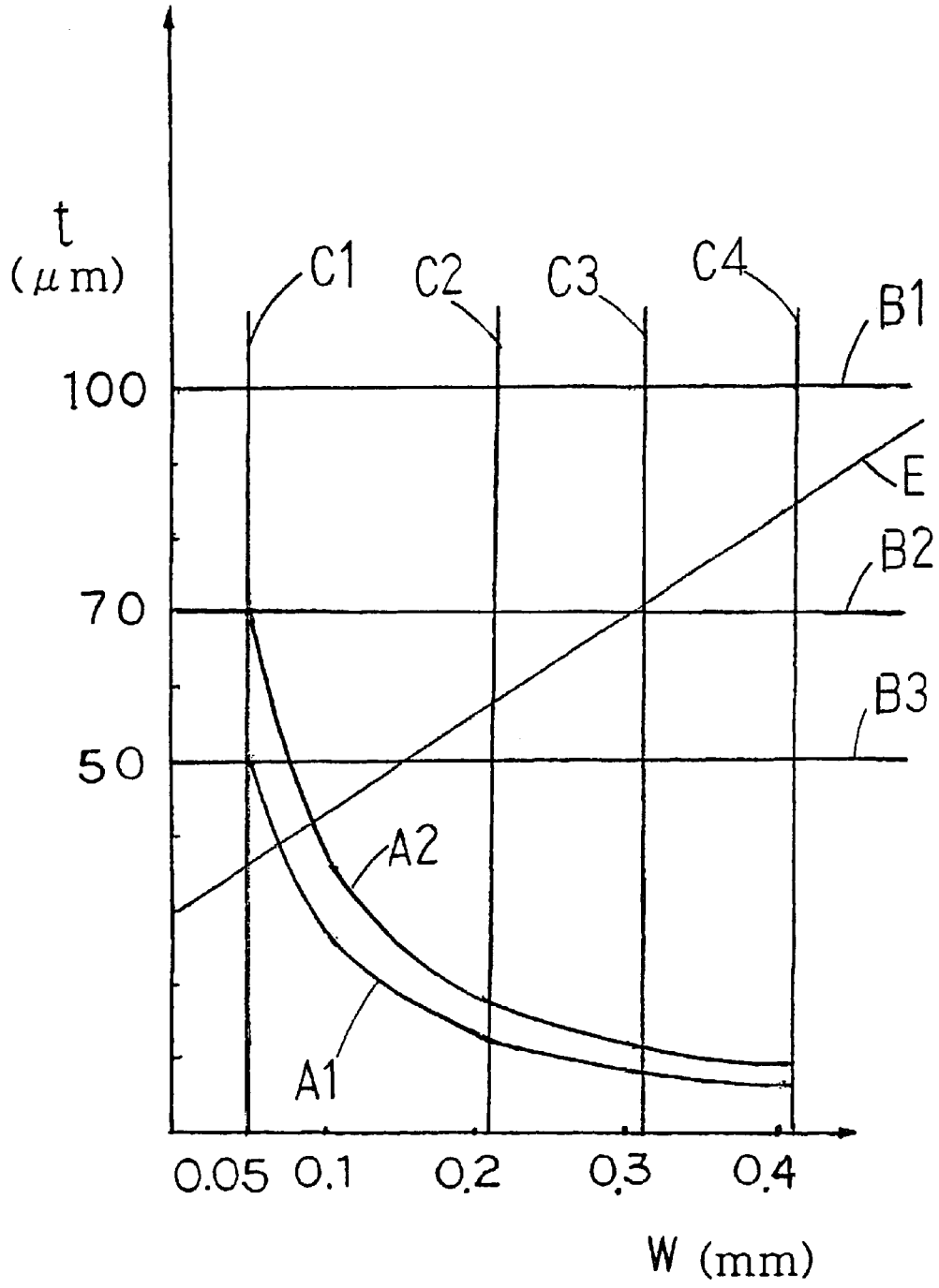
FIG. 1 is a diagram showing the relation between w and t wherein R/L of the antenna strip of the present invention is 0.2 Ω/cm or less.

In the following, preferred embodiments of the present invention will be described with reference to the drawings.

In the present invention, a linear silver paste layer is formed on an automobile window glass sheet, and the silver paste layer is fired whereby an antenna strip is formed. The silver paste is a silver-containing paste which comprises silver as the main component, an inorganic component such as glass and an organic binder. After heating for firing and sintering, the organic binder disappears and the silver and the inorganic component such as glass remain.

The width of the antenna strip is in a range of from 0.05 to 0.41 mm. If the width exceeds 0.41 mm, an excellent viewing field would not be assured. If the width is less than 0.05 mm, it would be difficult to form the antenna strip satisfactorily. Therefore, the width is preferably in a range of from 0.05 to 0.31 mm, more preferably, from 0.05 to 0.21 mm.

In the present invention, the specific resistance ρ of the antenna strip is 5.0 μΩcm or more. When the specific resistance is 5.0 μΩcm or more, an excessive increase of the content of silver in the silver paste can be prevented in comparison with a case that the specific resistance is less than 5.0 μΩcm. Accordingly, an excessive reduction of the content of the inorganic component in the silver paste can be prevented. As a result, a good sintered product is obtainable, and there is a small possibility that the strength of a terminal, after it has been connected to a power feeding point of the antenna strip by soldering or the like, is weak. Further, the migration of the silver does not seldom occur, and there is a small possibility that the outer appearance is not good. More preferably, the specific resistance ρ of the antenna strip is 7.0 μΩcm or more.

The thickness t of the antenna strip is 100 μm or less. When it is 100 μm or less, a good sintered product is obtainable, and there is a small possibility that the strength of a terminal, after it has been connected to a power feeding point of the antenna strip by soldering or the like, is weak, in comparison with a case that the thickness exceeds 100 μm. Preferably, the thickness is 70 μm or less, more preferably, 50 μm or less.

The specific resistance ρ (μΩcm), the electric resistance R (Ω), the length L of the conductor of the antenna strip (cm) and the cross-sectional area S ($cm^2$) in a width direction of the antenna strip have the relation as expressed by Formula 1. Since the shape cross-sectioned in a width direction of the antenna strip can be considered to be substantially rectangular, the above-mentioned S ($cm^2$), the thickness t (μm) of the antenna strip and the width w (mm) of the antenna strip have the relation as expressed by Formula 2. From Formulae 1 and 2, Formula 3 relating to t (μm) can be derived.

$$R=10^{-6}\cdot\rho\cdot L/S \qquad \text{Formula 1}$$

$$S=10^{-5}\cdot t\cdot w \qquad \text{Formula 2}$$

$$t=10^{-1}\cdot\rho/[w\cdot(R/L)] \qquad \text{Formula 3}$$

From Formula 3, the relation between t and w wherein ρ=5.0 μΩcm and R/L=0.2 Ω/cm is shown by a curved line A1. Similarly, the relation between t and w wherein ρ=7.0 μΩcm and R/L=0.2 Ω/cm is shown by a curved line A2. The relation between t and w wherein ρ=5.0 μΩcm and R/L=0.1 Ω/cm is shown by a curved line D1. The relation between t and w wherein ρ=7.0 μΩcm and R/L=0.1 Ω/cm is shown by a curved line D2.

t=2.5/w . . . curved line A1 t=3.5/w . . . curved line A2 t=5.0/w . . . curved line D1 t=7.0/w . . . curved line D2

The range of w (i.e., 0.05 to 0.41 mm, preferably, 0.05 to 0.31 mm, more preferably, 0.05 to 0.21 mm), the range of t (i.e., 100 μm or less, preferably, 70 μm or less, more preferably, 50 μm or less) and the curved lines A1, A2, D1 and D2, which are described above, are shown in FIGS. 1 and 2 showing coordinate planes defined by an ordinate as t and an abscissa as w, provided that FIG. 1 is in a case of R/L≦0.2 Ω/cm and FIG. 2 is in a case of R/L≦0.1 Ω/cm.

Figure 2:
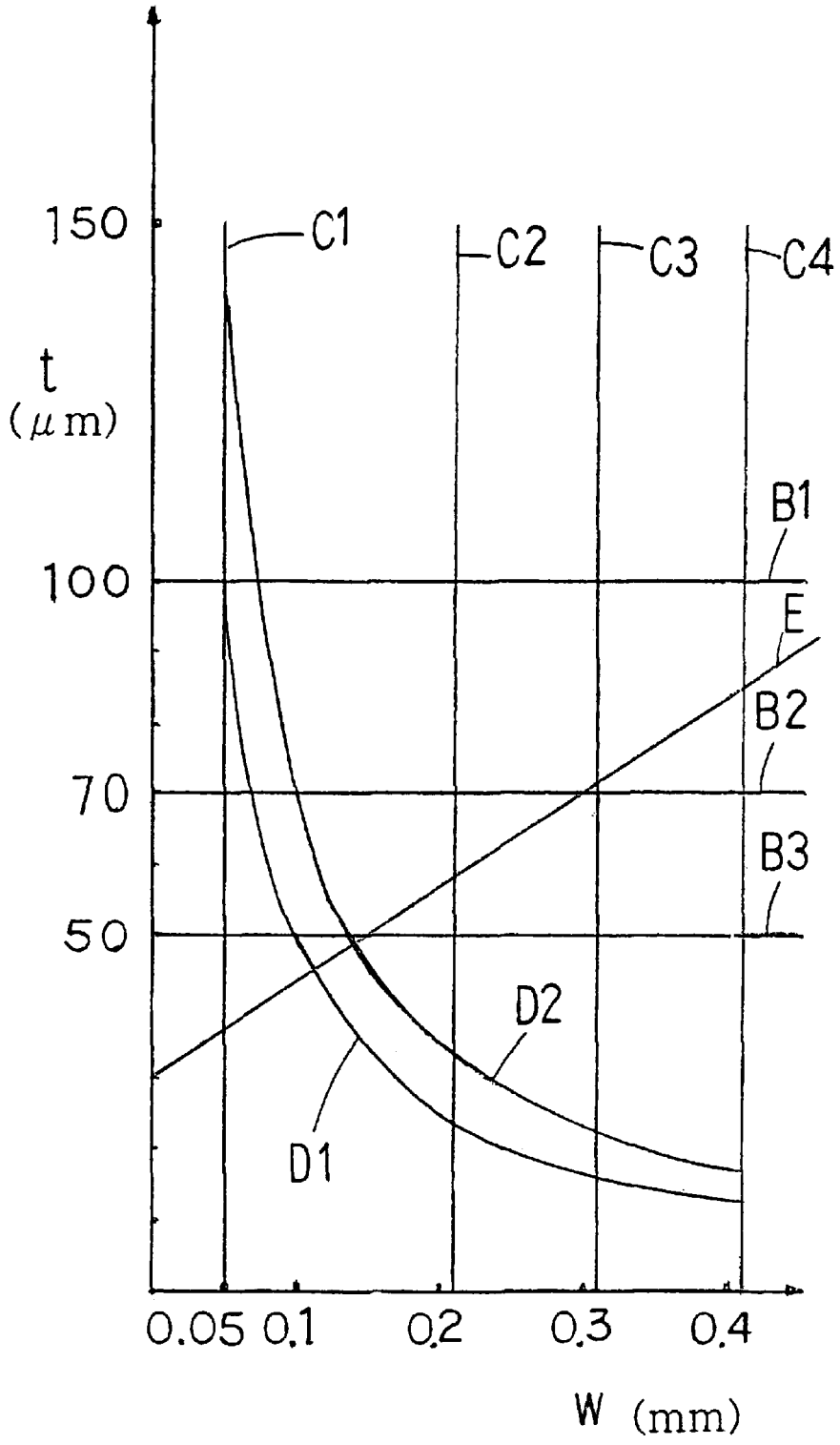
FIG. 2 is a diagram showing the relation between w and t wherein R/L of the antenna strip of the present invention is 0.1 Ω/cm or less.

In FIGS. 1 and 2, a straight line B1 shows t=100 μm, a straight line B2 shows t=70 μm, a straight line B3 shows t=50 μm, a straight line C1 shows w=0.05 mm, a straight line C2 shows w=0.21 mm, a straight line C3 shows w=0.31 mm and a straight line C4 shows w=0.41 mm.

As understood from FIG. 1, when R/L is 0.2 Ω/cm or less, ρ is 5.0 μΩcm or more, and when regions are arranged in decreasing order of area, there are the following regions 1) to 3). The region 2) is better than the region 1), and the region 3) is better than the region 2) from the viewpoints of telecommunication characteristics, viewing field and improvement of productivity.

1) The region surrounded by curved line A1, straight line B1, straight line C1 and straight line C4, 2) the region surrounded by curved line A1, straight line B2, straight line C1 and straight line C3, and 3) the region surrounded by curved line A1, straight line B3 and straight line C2.

In the description of the present invention, the region surrounded by the curved line A1, the straight line B3 and the straight line C2 includes the line portions (on the line) of the curved line A1, the straight line B3 and the straight line C2.

Similarly, as understood from FIG. 1, in a case that ρ is 7.0 μΩcm or more, and when regions are arranged in decreasing order of area, there are the following regions 4) to 6). The region 5) is better than the region 4), and the region 6) is better than the region 5) from the viewpoints of telecommunication characteristics, viewing field and improvement of productivity.

4) The region surrounded by curved line A2, straight line B1, straight line C1 and straight line C4, 5) the region surrounded by curved line A2, straight line B2 and straight line C3, and 6) the region surrounded by curved line A2, straight line B3 and straight line C2.

As understood from FIG. 2, when R/L is 0.1 Ω/cm or less, ρ is 5.0 μΩcm, and when regions are arranged in decreasing order of area, there are the following regions 7) to 9). The region 8) is better than the region 7), and the region 9) is better than the region 8) from the viewpoints of telecommunication characteristics, viewing field and improvement of productivity.

7) The region surrounded by curved line D1, straight line B1 and straight line C4, 8) the region surrounded by curved line D1, straight line B2 and straight line C3, and 9) the region surrounded by curved line D1, straight line B3 and straight line C2.

Similarly, as understood from FIG. 2, in a case that ρ is 7.0 μΩcm or more, and when regions are arranged in decreasing order of area, there are the following regions 10) to 12). The region 11) is better than the region 10), and the region 12) is better than the region 11) from the viewpoints of telecommunication characteristics, viewing field and improvement of productivity.

10) The region surrounded by curved line D2, straight line B1 and straight line C4, 11) the region surrounded by curved line D2, straight line B2 and straight line C3, and 12) the region surrounded by curved line D2, straight line B3 and straight line C2.

The straight line which defines a region in which it is difficult to peel off the antenna strip from the window glass sheet is indicated by a linear line E in FIGS. 1 and 2. The region surrounded by the straight line E and the axis of w shows such region in which it is difficult to peel off the antenna strip from the window glass sheet. The linear line E can be expressed by the following formula.

$$t=(40/0.3)w+30 \qquad \text{straight line E}$$

As understood from FIG. 1, when R/L is 0.2 Ω/cm or less, ρ is 5.0 μΩcm or more, and when regions are arranged in decreasing order of area, there are the following regions 13) to 15). The region 14) is better than the region 13), and the region 15) is better than the region 14) from the viewpoints of telecommunication characteristics, viewing field and anti-peeling characteristics.

13) The region surrounded by curved line A1, straight line E and straight line C4,

14) the region surrounded by curved line A1, straight line B2, straight line E and straight line C3, and

15) the region surrounded by curved line A1, straight line B3, straight line E and straight line C2.

Similarly, as understood from FIG. 1, in a case that ρ is 7.0 μΩcm or more, and when regions are arranged in decreasing order of area, there are the following regions 16) to 18). The region 17) is better than the region 16), and the region 18) is better than the region 17) from the viewpoints of telecommunication characteristics, viewing field and anti-peeling characteristics.

16) The region surrounded by curved line A2, straight line E and straight line C4,

17) the region surrounded by curved line A2, straight line B2, straight line E and straight line C3, and

18) the region surrounded by curved line A2, straight line B3, straight line E and straight line C2.

As understood from FIG. 2, when R/L is 0.1 Ω/cm or less, ρ is 5.0 μΩcm or more, and when regions are arranged in decreasing order of area, there are the following regions 19) to 21). The region 20) is better than the region 19), and the region 21) is better than the region 20) from the viewpoints of telecommunication characteristics, viewing field and anti-peeling characteristics.

19) The region surrounded by curved line D1, straight line E and straight line C4,

20) the region surrounded by curved line D1, straight line B2, straight line E and straight line C3, and

21) the region surrounded by curved line D1, straight line B3, straight line E and straight line C2.

Similarly, as understood from FIG. 2, in a case that ρ is 7.0 μΩcm or more, and when regions are arranged in decreasing order of area, there are the following regions 22) to 24). The region 23) is better than the region 22), and the region 24) is better than the region 23) from the viewpoints of telecommunication characteristics, viewing field and anti-peeling characteristics.

22) The region surrounded by curved line D2, straight line E and straight line C4,

23) the region surrounded by curved line D2, straight line B2, straight line E and straight line C3, and

24) the region surrounded by curved line D2, straight line B3, straight line E and straight line C2.

The glass antenna for an automobile according to the present invention can be used for a frequency band such as an AM broadcast band, a middle wave broadcast band (MW band) (520 to 1,700 kHz), a long wave broadcast band (LW band) (150 to 280 kHz), a short wave broadcast band (SW band) (2.3 to 26.1 MHz), an FM broadcast band in Japan (76 to 90 MHz), an FM broadcast band in U.S.A (88 to 108 MHz), a VHF band for television (90 to 108 MHz and 170 to 222 MHz), a UHF band for television (470 to 770 MHz), a 800 MHz band for vehicle telephone (810 to 960 MHz), a 1.5 GHz band for vehicle telephone (1.429 to 1.501 GHz), a UHF band (300 MHz to 3 GHz), a 1575.42 MHz for GPS signals from GPS satellite, VICS (VEHICLE INFORMATION AND COMMUNICATION SYSTEM) and so on, and there is in particular no limitation.

As a window glass sheet on which the glass antenna for an automobile according to the present invention is provided, there is a rear window glass sheet, a side window glass sheet, a front window glass sheet, a roof window glass sheet or the like, and there is in particular no limitation. Further, in a case that an electrically heating type defogger is provided on an automobile window glass sheet, and the defogger is used as an antenna, the line for constituting the defogger is the antenna strip of the present invention.

Now, the present invention will be described in detail with reference to Examples 1 to 4. However, it should be understood that the present invention is by no means restricted to such specific Examples 1 to 4.

EXAMPLE 1

A silver paste was printed linearly on a surface of car-interior-side of a rear side window glass sheet of automobile. The printed silver paste was fired to form an antenna strip. The used silver paste was such one containing an inorganic component comprising substantially 86.40% of silver and 5.92% of glass and the other inorganic component of 7.68% in terms of percentage by mass. The numerical values of the antenna strip was ρ=7.2 μΩcm, w=0.20 mm, t=38 μm, R/L=0.095 Ω/cm and L=58 cm. The antenna strip was in a completely sintered state, and there was nothing to prevent the viewing field. Further, in receiving FM broadcast signals, the antenna strip showed good signal receiving characteristics.

EXAMPLE 2

A silver paste was printed linearly on a surface of car-interior-side of a rear side window glass sheet of automobile. The printed silver paste was fired to form an antenna strip. The used silver paste was such one containing an inorganic component comprising 83.75% of silver and 6.25% of glass and the other inorganic component of 10.00% in terms of percentage by mass. The numerical values of the antenna strip was ρ=9.5 μΩcm, w=0.20 mm, t=25 μm, R/L=0.19 Ω/cm and L=58 cm. The antenna strip was in a completely sintered state, and there was nothing to prevent the viewing field. Further, in receiving FM broadcast signals, the antenna strip showed good signal receiving characteristics.

EXAMPLE 3

The same silver paste as used in Example 1 was printed linearly on a surface of car-interior-side of a window glass sheet. The printed silver paste was fired to form an antenna strip. Tests for anti-peeling characteristics were conducted while the width w of the antenna strip and the thickness t of the antenna strip were changed during the tests. A diamond pen (Model: D-point pen, manufactured by Ogura Houseki Seiki Kogyo K.K.) was oriented perpendicular to the window glass sheet. The diamond pen was moved 5 times in a direction perpendicular to the antenna strip at a speed of 0.5 mm/sec while a load was applied to the diamond pen. Table 1 shows a result. In Table 1, a character A denotes that the breaking occurs with a load of 600 g; a character B denotes that the breaking occurs with a load of 500 g; a character C denotes that the breaking occurs with a load of 400 g, and a character D denotes that the breaking occurs with a load of 300 g.

Since A and B show good results in Table 1, the rightness of the formula relating to the straight line E showing the anti-peeling characteristics was proven.

TABLE 1

| | t (μm) | | | | |
|---|---|---|---|---|---|
| w (mm) | 10 | 30 | 50 | 70 | 90 |
| 0.50 | A | A | A | A | A |
| 0.45 | A | A | A | A | B |
| 0.40 | A | A | A | B | C |
| 0.35 | A | A | A | B | C |
| 0.30 | A | A | A | B | C |
| 0.25 | A | A | B | C | C |
| 0.20 | A | A | B | C | C |
| 0.15 | A | A | B | C | D |
| 0.10 | A | B | C | D | D |

EXAMPLE 4

Tests for anti-peeling characteristics were conducted in the same method as Example 3 except that the silver paste used in Example 2 was used. As a result, the same result as in Example 1 was obtained.

The glass antenna for an automobile of the present invention is excellent in sintering characteristics; assures a good viewing field and provides good telecommunication characteristics and anti-peeling characteristics.

The entire disclosure of Japanese Patent Application No. 2001-127979 filed on Apr. 25, 2001 including specification, claims, drawings and summary are incorporated herein by reference in its entirety.

What is claimed is:

1. A glass antenna for an automobile including an antenna strip, said antenna strip including a linear silver paste layer fired on an automobile window glass sheet, said antenna strip comprising:

an electric resistance per unit length of the antenna strip of 0.2 Ω/cm or less; and an electric resistivity ρ of the silver paste of 5.0 μΩcm or more, wherein said antenna strip is defined by a curved line A1 with a thickness $t_{A1}$ and a width $w_{A1}$, a straight line B1 with a thickness $t_{B1}$, a straight line C1 with a width $w_{C1}$, and a straight line C4 with a width $w_{C4}$, arranged to form antenna strip thicknesses t (μm) and antenna widths w (mm) as follows $t_{A1}=2.5/w_{A1}$, $t_{B1}=100$, $w_{C1}=0.05$, and $w_{C4}=0.41$.

2. The glass antenna of claim 1, wherein said antenna strip is further defined by a straight line B2 with a thickness $t_{B2}$ and a straight line C3 with a width $w_{C3}$ arranged to form antenna strip thicknesses t (μm) and antenna widths w (mm) as follows:

$t_{B2}=70$, and $w_{C3}=0.31$.

3. The glass antenna of claim 1, wherein said antenna strip is further defined by a curved line A2 with a thickness $t_{A2}$ and a width $w_{A2}$ arranged to form antenna strip thicknesses t (μm) and antenna widths w (mm) as follows:

$t_{A2}=3.5/w_{A2}$, such that the electric resistivity ρ of the silver paste is 7.0 μΩcm or more.

4. A glass antenna for an automobile including an antenna strip, said antenna strip including a linear silver paste layer fired on an automobile window glass sheet, said antenna strip comprising:

an electric resistance per unit length of the antenna strip of 0.1 Ω/cm or less; and an electric resistivity ρ of the silver paste of 5.0 μΩcm or more, wherein said antenna strip is defined by a curved line D1 with a thickness $t_{D1}$ and width $w_{D1}$, a straight line B1 with a thickness $t_{B1}$, and a straight line C4 with a width $w_{C4}$, arranged to form antenna strip thicknesses t (μm) and antenna widths w (mm) as follows $t_{D1}=5.0/w_{D1}$, $t_{B1}=100$, and $w_{C4}=0.41$.

5. The glass antenna of claim 1, wherein said antenna strip is further defined by a straight line B2 with a thickness $t_{B2}$ and a straight line C3 with a width $w_{C3}$ arranged to form antenna strip thicknesses t (μm) and antenna widths w (mm) as follows:

$t_{B2}=70$, and $w_{C3}=0.31$.

6. The glass antenna of claim 4, wherein said antenna strip is further defined by a curved line D2 with a thickness $t_{D2}$ and a width $w_{D2}$ arranged to form antenna strip thicknesses t (μm) and antenna widths w (mm) as follows:

$t_{D2}=7.0/w_{D2}$, such that the electric resistivity ρ of the silver paste is 7.0 μΩcm or more.

7. A glass antenna for an automobile including an antenna strip, said antenna strip including a linear silver paste layer fired on an automobile window glass sheet, said antenna strip comprising:

an electric resistance per unit length of the antenna strip of 0.2 Ω/cm or less; and an electric resistivity ρ of the silver paste of 5.0 μΩcm or more, wherein said antenna strip is defined by a curved line A1 with a thickness $t_{A1}$ and a width $w_{A1}$, a straight line E with a thickness $t_E$ and a width $w_E$ and a straight line C4 with a width $w_{C4}$ arranged to form antenna strip thicknesses t (μm) and antenna widths w (mm) as follows $t_{A1}=2.5/w_{A1}$ for curved line A1, $t_E=(40/0.3)w_E+30$, and $w_{C4}=0.41$.

8. The glass antenna of claim 7, wherein said antenna strip is further defined by a straight line B2 with a thickness $t_{B2}$ and a straight line C3 with a width $w_{C3}$ arranged to form antenna strip thicknesses t (μm) and antenna widths w (mm) as follows:

$t_{B2}=70$, and $w_{C3}=0.31$.

9. The glass antenna of claim 7, wherein said antenna strip is further defined by a curved line A2 with a thickness $t_{A2}$ and a width $w_{A2}$ arranged to form antenna strip thicknesses t (μm) and antenna widths w (mm) as follows:

$t_{A2}=3.5/w_{A2}$, such that the electric resistivity ρ of the silver paste is 7.0 μΩcm or more.

10. A glass antenna for an automobile including an antenna strip, said antenna strip including a linear silver paste layer fired on an automobile window glass sheet, said antenna strip comprising:

an electric resistance per unit length of the antenna strip of 0.1 Ω/cm or less; and an electric resistivity ρ of the silver paste of 5.0 μΩcm or more, wherein said antenna strip is defined by a curved line D1 with a thickness $t_{D1}$ and a width $w_{D1}$, a straight line E with a thickness $t_E$ and a width $w_E$ and a straight line C4 with a width $w_{C4}$, arranged to form antenna strip thicknesses t (μm) and antenna widths w (mm) as follows $t_{D1}=5.0/w_{D1}$, $t_E=(40/0.3)w_E+30$, and $w_{C4}=0.41$.

11. The glass antenna of claim 10, wherein said antenna strip is further defined by a straight line B2 with a thickness $t_{B2}$ and a straight line C3 with a width $w_{C3}$ arranged to form antenna strip thicknesses t (μm) and antenna widths w (mm) as follows:

$t_{B2}=70$, and $w_{C3}=0.31$.

12. The glass antenna of claim 10, wherein said antenna strip is further defined by a curved line D2 with a thickness $t_{D2}$ and a width $w_{D2}$ arranged to form antenna strip thicknesses t (μm) and antenna widths w (mm) as follows:

$t_{D2}=3.5/w_{D2}$, such that the electric resistivity ρ of the silver paste is 7.0 μΩcm or more.

* * * * *